US005123603A

United States Patent [19]

Hayez et al.

[11] Patent Number: 5,123,603

[45] Date of Patent: Jun. 23, 1992

[54] MULTI-WIDTH WINDER

[75] Inventors: Yvon Hayez, Brussels; Hubert Coninck, Ath, both of Belgium

[73] Assignee: Solvay & Cie (Societé Anonyme), Brussels, Belgium

[21] Appl. No.: 552,518

[22] Filed: Jul. 16, 1990

[30] Foreign Application Priority Data

Jul. 17, 1989 [BE] Belgium ..... 08900776

[51] Int. Cl.[5] ..... B65H 18/10

[52] U.S. Cl. ..... 242/56.9

[58] Field of Search ..... 242/56.9, 56.2, 75.5, 242/46.2, 46.21, 46.4, 67.1 R

[56] References Cited

U.S. PATENT DOCUMENTS

| | | | |
|---|---|---|---|
| 2,869,381 | 1/1959 | Chandler . | |
| 3,934,833 | 1/1976 | Nash et al. | 242/56.9 |
| 4,497,455 | 2/1985 | Kampf et al. | 242/56.9 |
| 4,593,864 | 6/1986 | Stromme | 242/56.9 |

FOREIGN PATENT DOCUMENTS

| | | | |
|---|---|---|---|
| 0155460 | 9/1985 | European Pat. Off. . | |
| 2156495 | 5/1973 | Fed. Rep. of Germany | 242/56.9 |
| 3215204 | 11/1983 | Fed. Rep. of Germany . | |
| 384320 | 2/1965 | Switzerland . | |

*Primary Examiner*—John M. Jillions

*Attorney, Agent, or Firm*—Spencer, Frank & Schneider

[57] ABSTRACT

The winder comprises a central driving carrier tube (1) and winding drums (2) equipped with self-blocking systems (3) for receiving reeling mandrils (4) arranged successively round the central driving carrier tube, the said drums (2) each being connected to this tube by means of a magnetic coupling (16), (17), (18) located inside the said tube (1) and connected, on the one hand, rigidly to this tube (1) and, on the other hand, to the drum (2), in said winder the connection between the magnetic coupling (16), (17), (18) and the drum (2) being made via a speed multiplier (6), (6'), (6''), (13) likewise arranged in the central driving carrier tube (1). The winder allows a reeling of a series of widths cut from the web material, this being carried out with controlled winding tensions.

7 Claims, 1 Drawing Sheet

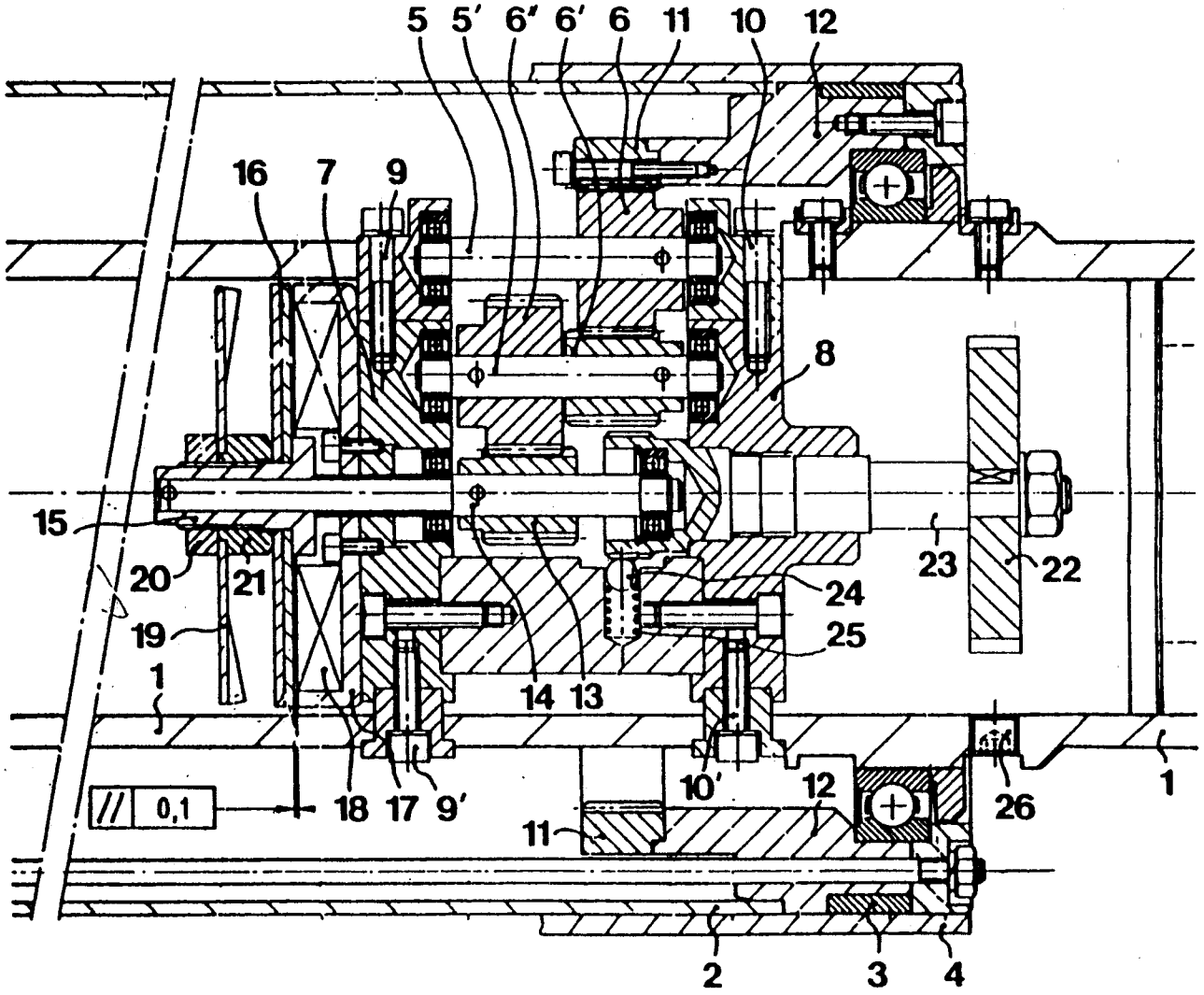
1
22
26
23
4
3
12
8
24
25
12
10
10'
2
11
6
6'
13
6'
14
11
5'
5
9'
9
17
7
18
16
21
20
19
1
15
0,1

MULTI-WIDTH WINDER

FIELD OF THE INVENTION

The present invention relates to an improved multi-width winder which is intended to be arranged at the exit of a production line for materials in the form of a continuous web, particularly for the purpose of reeling up a plurality of widths cut longitudinally from these materials.

TECHNOLOGY REVIEW

When sheets or films made especially of thermoplastic are produced, for example by calendering or extrusion, it is often expedient, at the exit of the production line, to cut these products longitudinally in order to obtain a plurality of widths of desired size, the widths thus obtained subsequently having to be wound in the form of reels so that they can be dispatched to their places of use.

However, the winding or reeling of a series of simultaneously produced widths on a series of reeling spindles gives rise to the difficult problem of the correct control of the tension during the winding of the various widths.

A solution sometimes adopted involves using a single-width winding machine. However, such a solution proves costly, complex and inflexible where varied production is concerned. Thus, if there is a need to recover a web material of full size, hence without previous cutting, for some types of use, it becomes necessary to provide another winder allowing full-breadth winding.

Consequently, to reduce the investment costs, a single winder intended for full-breadth winding and equipped with a device for cutting into widths is often installed on such lines The winding of a plurality of widths cut from the web produced is possible on this type of machine, provided that this is equipped with a special winding shaft on which the winding mandrils are arranged A first well-known type of special winding shaft is the expandable shaft It consists of a cylinder equipped, on its periphery, with moveable claws intended for catching the winding mandrils which are pushed towards the outside of the cylinder under the action of a pneumatically inflatable internal bladder. The major disadvantage of this type of shaft is that it imposes the same rotational speed on all the winding mandrils. However, a web material, such as a plastic sheet, produced by calendering or by extrusion never has a strictly constant thickness over its entire width. Thus, during a simultaneous winding of a plurality of widths obtained from such a sheet, the successive diameters of the various reels produced do not remain equal. Consequently, the expandable shaft results in a production of reels at linear winding speeds which can be different, the more so the greater the variations of thickness in the sheets and the larger the number of wound turns. The result of this is, therefore, that the winding tensions of the various reels do not remain strictly identical. Some relatively rigid or thick products can accept this state of affairs because they can tolerate a wide range of winding tensions. In contrast, where flexible or relatively thin products are concerned, it is essential to set a relatively low winding tension with a narrow tolerance, and moreover this tension must be variable as a function of the diameter of the reels during production. In this case, it is impossible to use an expandable shaft because the reels produced are too loose or too tight.

A first solution put into practice at the present time in order to solve this problem involves using mechanical-friction shafts. The basic idea of such a shaft is, by means of mechanical-friction systems, to divide the total winding torque into as many equal parts as there are winding drums, in order thereby to guarantee a smaller difference between the winding tensions of the various widths.

This type of shaft nevertheless has a series of disadvantages:

As in any friction system, the force or torque transmitted between the two parts of the system is a function of the clamping force which lays these parts on to one another. To control the various winding torques and therefore the tensions in the widths, it is consequently necessary to vary the clamping forces by any external means. The winders working with mechanical-friction shafts therefore have to be designed especially for their use as regards both regulation and control.

Because any mechanical-friction system becomes worn in time, it is essential to carry out periodic dismantling operations for cleaning and maintenance The control of the winding tension as a function of the diameter of the reels is not very accurate, the more so when the wound products require low winding tensions.

Another solution described in the patent UK-A-2,121,386 relates to a special multi-width winder which employs both a friction drive and a magnetic coupling and which is suitable for the winding of small reels. However, the use of such an apparatus for the continuous production of heavy reels, particularly on a universal winder which can also be used for the full-breadth winding of an uncut web material, would result in the need to provide an oversized magnetic coupling which, furthermore, would give rise to heating problems or would be impracticable. Moreover, in such a machine, the friction drive remains subject to problems of wear.

The object of the present invention is, therefore, to provide a multi-width winder which is based on a drive via magnetic couplers and which no longer has the abovementioned disadvantages.

SUMMARY OF THE INVENTION

The present invention thus relates to a multi-width winder arranged at the exit of a production line for web materials and comprising a central driving carrier tube and winding drums equipped with self-blocking systems for receiving reeling mandrils arranged successively round the central carrier tube, the said drums each being connected to this tube by means of a magnetic coupling located inside the said tube and connected, on the one hand, rigidly to this tube and, on the other hand, to the drum, characterized in that the connection between the magnetic coupling and the drum is made via a speed multiplier likewise arranged in the central driving carrier tube.

It was found, in fact, that the use of a speed multiplier makes it possible to reduce the dimensions of the magnetic coupling considerably, without in any way impairing the performances of the winder. It is thus possible to accommodate the magnetic coupling and the planetary speed multiplier inside the central driving carrier tube and therefore to use winding drums which are virtually contiguous. Furthermore, as a result of this, the magnetic coupling and the speed multiplier are thereby protected by the central driving carrier tube against any external attack. Moreover, in the winder according to the invention, the use of a speed multiplier makes it possible to reduce considerably the energy dissipated by the magnetic coupling and therefore its heating during operation. Besides, employing a magnetic coupling for driving each drum allows an efficient control of the winding tensions of the various widths, this being obtained even as a function of the diameter of the reels during production. Finally, the winder according to the invention requires only a single conventional regulating system, whatever the number of reeling mandrils.

DETAILED DESCRIPTION OF THE INVENTION

To produce the winder according to the invention, it is preferable to use magnetic couplings of the permanent-magnet eddy-current type, thereby making it possible, on the one hand, to avoid any need for electrical connections and, on the other hand, to control the winding tensions by acting on the differences in angular speed. It proves expedient, moreover, to employ magnetic couplings adjustable by a variation of their flux gap.

It can also prove advantageous to equip each magnetic coupling with a cooling system. It is known, in fact, that permanent magnets which, for example, equip magnetic couplings of the eddy-current type lose their magnetization irreversibly when their temperature exceeds approximately 100° C. The cooling system can be obtained, for example, by providing suitable orifices in the central driving carrier tube, to allow a circulation of air in this tube, or by fastening a vaned wheel to the armature of the magnetic coupling.

To obtain the winder according to the invention, a speed multiplier having a step-up ratio of between 2 and 200, preferably between 2 and 50, is generally used. It is likewise advantageous to employ a speed multiplier which is self-lubricated. Self-lubrication of the speed multiplier can be obtained, for example, by using, to produce it, a sufficient number of toothed pinions made from a suitable plastic filled with a lubricating material, such as graphite. It is generally preferable to use speed multipliers of the planetary type.

In general, the number of drums equipping the winder is equal to the number of reeling mandrils to be arranged on the winder. However, the winder according to the invention can have a number of drums larger than the number of mandrils, especially in instances where the web material has to be cut into a plurality of width sizes or when the number of cuts of the web material is likely to need to vary. In this case, a reeling mandril can rest simultaneously on a plurality of drums, without thereby disturbing the smooth functioning of the winder Each drum equipping the winder is, of course, equipped with a conventional system making it possible to grip the reeling mandrils for the purpose of fixing them to the drums.

The magnetic coupling is arranged inside the central driving tube, in such a way that its inductor is fixed to this tube and that the axle carrying the armature can rotate freely in this tube. Furthermore, this axle can advantageously be produced so as to be longitudinally displaceable and controllable in order to allow an adjustment of the flux gap between the inductor and the armature for the purpose of setting the operating characteristics of the various drums during assembly or of making it possible to modify these characteristics, should the drums be equipped with reeling mandrils of different widths.

The speed multiplier, preferably of the planetary type, which is used according to the invention is connected, on the one hand, to the axle carrying the armature and, on the other hand, to a toothed ring provided on the inner face of each drum, the link between these connections being made via a series of toothed pinions keyed on parallel axles which can rotate freely between support plates fixed to the central driving tube and arranged in this.

It is quite clear, however, that any other type of speed multiplier can be used.

Employing a speed multiplier which, in fact, multiplies the characteristic of the magnetic coupling by the square of its reduction ratio makes it possible to obtain higher torque values for speed differences compatible with the rotational speeds of the driving tube. Moreover, the power dissipated by the magnetic coupling is reduced and the rotational speed of this coupling is increased, thereby assisting its cooling.

In order to limit the frictional torque of the magnetic-coupling/speed-multiplier assembly and to maintain this at a value below the minimum torque to be transmitted, it is advantageous:

to use bearings without a sealing ring and lubricated with a low-viscosity oil, to limit all the frictions particularly by ensuring sufficient lubrication, to use self-lubricating toothed pinions, such as pinions made from plastic filled with a lubricating material, such as graphite.

Thus, the winder according to the invention:

allows the total torque supplied to the central driving carrier tube to be distributed more effectively among the various reeling mandrils, requires only a single regulating system, whatever the number of widths to be reeled, reduces the problems of wear and soiling to a minimum, needs a minimum of maintenance, allows full-breadth windings or over variable width sizes, ensures higher accuracy in the control of the winding tensions, this being as a function of the diameters of the reels during production.

Moreover, the winder according to the invention is explained in more detail in a practical embodiment which will be described and for the description of which reference will be made to the single FIGURE of the accompanying drawing showing a portion of said winder in section.

As emerges from the FIGURE, the winder comprises a central driving carrier tube (1) which is continuous and which ensures the drive of all the drums (2) of the winder, only one of which is shown This central tube is driven at one of its ends (not shown). Each drum (2) is equipped with a reeling mandril (4) which is fixed to this drum (2) by means of a conventional self-blocking system (3).

Arranged inside the driving tube (1), level with each drum, is a magnetic eddy-current coupling, of which the inductor consisting of a permanent magnet (18) and of its support (17) is fastened to a partition (7) fixed to the central tube (1) by means of the fastenings (9) and (9'). The armature of the coupling, which consists of a double disk of copper and iron (16), is blocked by means of a fastening (15) on an axle (14) supported, on the one hand, by the partition (7) and, on the other hand, by a second spaced partition (8) likewise fixed to the driving tube (1) via fastenings (10) and (10'), the axle (14) being freely rotatable relative to these partitions However, this axle (14) can be displaced slightly in the axial direction under the push or pull of a partially threaded rod (23) mounted on the partition (8) and carrying a serrated adjusting wheel (22). Moreover, the axial positioning of the axle (14) can be blocked by means of a ball (24)/spring (25) system, this ball/spring system furthermore imposing a sequential rotation of the axle (14) because its end facing the ball (24) is likewise serrated. Fastened by means of the elements (15), (20) and (21) to the end of the axle (14) located beyond the armature is a vaned wheel (19), the function of which is to increase the heat-exchange surface of the armature (16), the thermal connection being made by means of the thermally conductive elements (15), (20) and (21).

Likewise blocked on the axle (14) and between the partitions (7) and (8) is a toothed pinion (13) which drives the speed multiplier consisting of the toothed pinions (6), (6') and (6'') arranged at stages on axles (5) and (5') which are parallel to the axle (14) and which can rotate freely in the partitions (7) and (8) supporting them. The last toothed pinion (6) is engaged in a toothed ring (11) which is fixed to the drum (2) via the fastening (12). An orifice (26) made in the driving tube (1) at one of the ends of each drum (2) makes it possible, during an initial adjustment, to introduce a tool in order to cause a sequential rotation of the serrated wheel (22) and consequently an adjustment of the flux gap between the inductor (17), (18) and the armature (16) of the magnetic coupling The operating characteristic of each drum (2) can thereby be set on the test bench from outside, without any dismantling.

In the winder, as described above, the torque transmitted between the driving tube (1) and each drum (2) is proportional to the difference in angular speed which exists between these elements, the proportionality coefficient being equal to the product of the coefficient of the coupler alone and the square of the step-up ratio of the planetary speed multiplier.

Thus, by action on the rotational speed of the driving tube, the winder described can control the torques transmitted to each of the drums, by virtue of construction and initial adjustment these torques remaining strictly identical for widths of constant size.

As a result of this, on the winder described, the winding tensions of the various widths to be reeled remain constantly equal to one another and can change together as a function of the instantaneous diameter of the reels according to a specific law determined by the conventional regulation of the winder.

We claim:

1. A multi-width winder arranged at the exit of a production line for web materials and comprising a central driving carrier tube and winding drums equipped with self-blocking systems for receiving reeling mandrils arranged successively around the central driving carrier tube, the winding drums each being connected to the carrier tube by means of a magnetic coupling located inside the carrier tube and having an input and an output, the input being connected to the carrier tube and the output being connected to the drum, the connection between the magnetic coupling and the drum being made via a speed multiplier arranged in the central driving carrier tube.

2. The winder according to claim 1, wherein the magnetic coupling is an eddy-current magnetic coupling.

3. The winder according to claim 1, wherein the magnetic coupling is adjustable by a variation of its flux gap.

4. The winder according to claim 1, wherein the magnetic coupling is equipped with a cooling system.

5. The winder according to claim 1, wherein the speed multiplier is a planetary speed multiplier.

6. The winder according to claim 1, wherein the step-up ratio of the speed multiplier is between about 2 and 200.

7. The winder according to claim 1, wherein the speed multiplier is self-lubricated.

* * * * *